United States Patent [19]

Threlfall

[11] 4,281,443

[45] Aug. 4, 1981

[54] POSITION MAINTAINING TOOL

[76] Inventor: James Threlfall, 4817 W. Pinchot, Phoenix, Ariz. 85031

[21] Appl. No.: 61,377

[22] Filed: Jul. 27, 1979

[51] Int. Cl.[3] ..... B25B 27/14

[52] U.S. Cl. ..... 29/271

[58] Field of Search ..... 81/3 R; 29/271

[56] References Cited

U.S. PATENT DOCUMENTS

| | | | |
|---|---|---|---|
| 2,377,973 | 6/1945 | Scott | 81/3 R X |
| 2,468,983 | 5/1949 | Johnson | 81/3 R |
| 3,240,472 | 3/1966 | Jones | 29/271 X |
| 3,584,364 | 6/1971 | Steck | 81/3 R |
| 3,909,905 | 10/1975 | Giordano | 29/271 |

*Primary Examiner*—James G. Smith

*Attorney, Agent, or Firm*—Cahill, Sutton & Thomas

[57] ABSTRACT

The position maintaining tool is keyed to the control arm intermediate the arms of a bushing supported A-frame in the front suspension system of a vehicle and maintains the A-frame arms positionally fixed upon the control arm during replacement of the bushings.

3 Claims, 4 Drawing Figures fig. 1
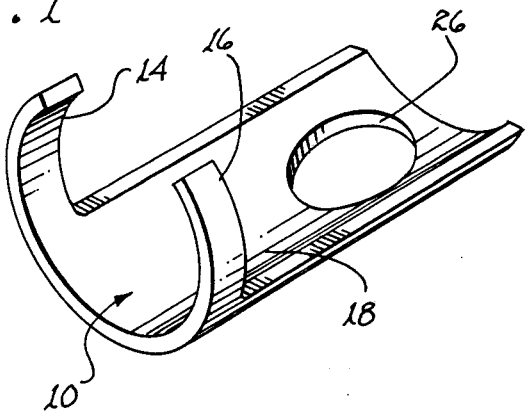
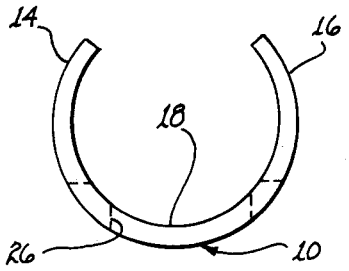
fig. 2
fig. 3
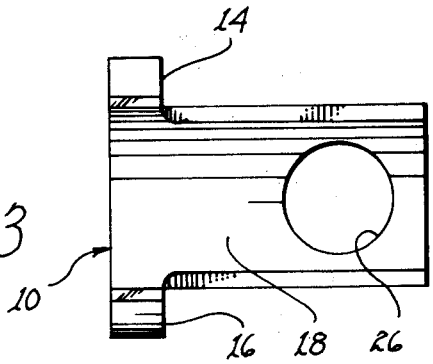
fig. 4
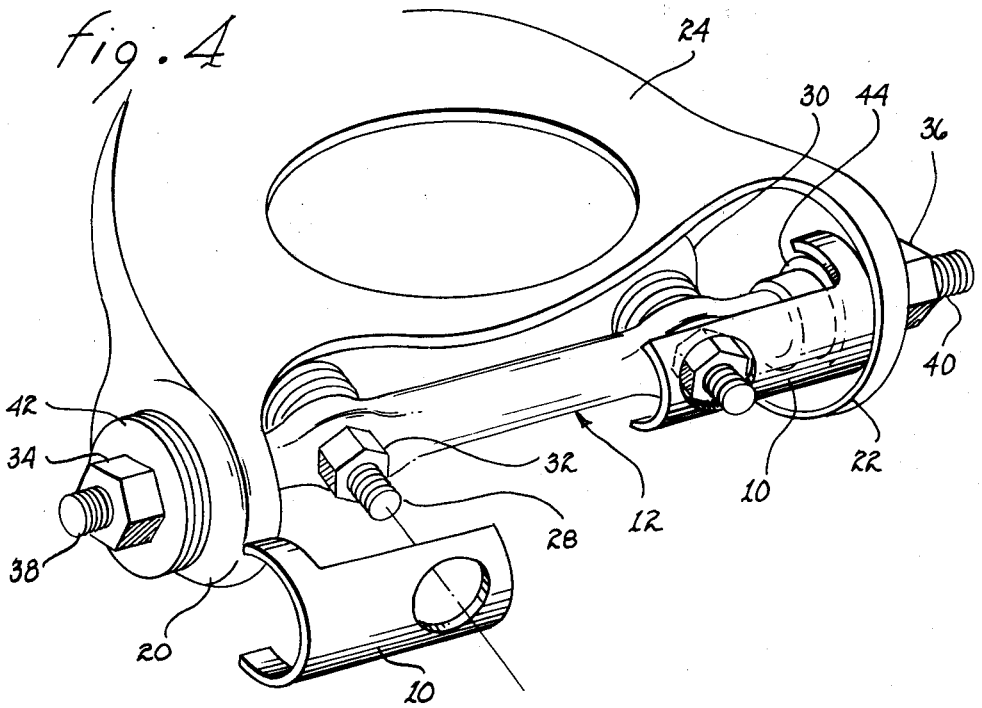

POSITION MAINTAINING TOOL

The present invention relates to position maintaining tools and, more particularly, to tools for aiding in the replacement of A-frame bushings on the front suspension of vehicles.

Most automotive vehicles incorporate A-frame members in the front suspension system to positionally maintain and support the front wheels. Coil springs, shock absorbers and the like interconnect the A-frame with the vehicular frame work as part of the suspension system. Each A-frame generally includes a pair of arms pivotally attached to and suspended from a frame mounted control arm. The positional relationship of the control arm to the frame generally determines the camber, cant and toe-in of the front wheels.

The interconnection between each arm of each A-frame and the respective control arm is generally a bushing. The bushing is normally of a rubber or other shock dampening compound which absorbs sharp impacts to smoothen the ride and yet maintains the A-frame positionally fixed fore and aft while accommodating pivotal movement of the A-frame in the vertical axis. These bushings are generally secured to the control arm by a bolt or other threaded means and are penetrably force fitted within an aperture in each of the arms of the A-frame.

As may be expected, the bushings wear at a rate dependant upon the nature of use of the vehicle. Consequently, the bushings must be periodically replaced. Presently, replacement of the bushings is only possible by complete removal from the vehicle of the A-frame and its attached control arm in order to remove the old bushings and install the new bushings. Removal of the A-frame and control arm also necessitates at least disconnection, if not removal, of a substantial number of ancillary apparatus, such as coil springs, shock absorbers, tie-rods, etc. Because of the substantial amount of work necessary to remove and reinstall the A-frames and the control arms, total time consumption for replacing the bushings is prodigious and consequently very expensive for the owner of the vehicle.

It is therefore a primary object of the present invention to provide a tool which permits replacement of vehicular front end bushings without removal of the respective A-frames.

Another object of the present invention is to reduce the time necessary to replace the bushings in the front end suspension system of a vehicle.

Yet another object of the present invention is to provide a tool for maintaining the A-frame positioned upon the respective control arm during bushing replacement.

A further object of the present invention is to provide a tool for maintaining the arms of an A-frame in a positionally locked engagement with the respective control arm during bushing replacement.

A yet further object of the present invention is to provide a tool for maintaining an element in positional relationship to a penetrably mounted shaft during replacement of interconnecting bushings.

A still further object of the present invention is to provide a tool for positionally maintaining two elements during replacement of an interconnecting medium therebetween.

These and other objects of the present invention will become apparent to those skilled in the art as the description thereof proceeds.

The present invention may be described with greater specificity and clarity with reference to the following drawings, in which:

FIG. 1 is a perspective view of a representative tool;

FIG. 2 is an end view of the tool;

FIG. 3 is a plan view of the interior of the tool; and

FIG. 4 illustrates the tool in use.

In most automotive vehicles, the control arms supporting the arms of the A-frames of the front suspension, penetrably engage threaded shafts extending from a rigid frame member. Shims intermediate the control arm and the frame are used to align the front wheels, depending to some degree upon the geometry of the suspension system. For manufacturing convenience and considerations of strength requirements, the control arms are generally shafts somewhat rounded in cross-section and laterally expanded in proximity to the apertures for receiving the threaded bolts, studs or shafts extending from the rigid frame member.

Each A-frame is generally of sheet metal formed into a triangle in plan form with depending edges extending from the base to the apex of the triangle. The apex is ultimately attached to the wheel itself while the depending edges extend from the base in the nature of arms to penetrably receive the opposed ends of the control arm. Hard rubber bushings or the like are disposed intermediate the control arm ends and the respective ones of the A-frame arms. These bushings may include metallic end caps which serve as bearing surfaces for nuts threadedly mounted upon shafts extending from the control arm or for bolt heads threadedly engaging cavities within the control arm.

The configuration of the A-frame and its depending sides forming the arms thereof are physically dimensioned so as to permit pivotal movement of the A-frame about an axis represented by the longitudinal axis of the control arm. Necessarily, sufficient clearance must be provided by the A-frame and its arms to prevent interference with the frame of the vehicle and other parts which may be in proximity thereto.

Referring to FIGS. 1 through 3, there is shown a tool 10 for engaging one end of control arm 12 (see also FIG. 4). The tool includes arms 14 and 16 extending from body 18; these arms are configured to contact and bear against the inner surface of arm 20 or 22 of A-frame 24. Tool 10 is lockingly engaged to the control arm by means of aperture 26 disposed in body 18. Aperture 26 is dimensioned to penetrably receive threaded shank 28 extending from the control arm and ultimately secured to rigid frame 30 of the vehicle. Alternately, aperture 26 may be sized to circumscribe a nut 32 in threaded engagement with shank 28. By proper dimensioning of arms 14 and 16 of each tool with respect to aperture 26, the tools operating in concert maintain the respective A-frame arms positionally located upon the respective ends of control arm 12.

Preferably, body 18 of tool 10 is curved about the longitudinal axis in general alignment with the corresponding surface curvature of the control arm. The resulting conformance between these two parts tends to aid in maintaining the tool in place. However, such conformance is not critical to operation of the tool.

The embodiment of tool 10 depicted in the drawings show body 18 to have constant curvature and each of arms 14 and 16 maintain the curvature and define a portion of the circle. This configuration resulted primarily from the fact that the tool was manufactured from a section of pipe. It is to be understood that the configuration illustrated is simply an embodiment of the present invention which functions admirably well. Other configurations may be developed which may be just as suitable.

From vehicle to vehicle, the spatial relationship between the A-frame arm contacting surfaces of arms 14 and 16 and aperture 26 will vary. Necessarily, tool 10 must be suitably adapted. Moreover, the size and/or spatial configuration of aperture 26 may be used to positionally lock the tool to the control arm.

In operation, a pair of tools 10 are mounted upon control arm 12 to positionally maintain arms 20 and 22 of A-frame 24 with respect to the longitudinal axis of the control arm. Thereafter, the nuts 24 and 26 are unthreaded off their respective shafts 38, 40. Conventional tools and techniques are thereafter employed to remove bushings 32 and 44 and replace them with new bushings. During and after removal of the bushings and during insertion of the replacement bushings, tools 10, disposed about opposed ends of control arm 12 positionally maintain arms 20 and 22 of A-frame 24 with respect to the control arm. Such positional maintenance of the A-frame is also sufficient to permit the normal application of force attendant both the removal and reinsertion of the bushings. It may be noted that the control arm remains attached to rigid member 30 and shims 31 remain undisturbed.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A tool for maintaining positional alignment intermediate a control arm and the arms of an A-frame in a front end suspension system of a vehicle during replacement of a control arm/A-frame interconnecting bushing, said tool comprising in combination:

(a) a body having a longitudinal axis:

(b) means for securing said body in fixed location upon the control arm to preclude movement of said body along its longitudinal axis:

(c) said body including a terminal end displaced from said securing means for bearing against and blocking movement of an arm of the A-frame toward the fixed location on the control arm along the longitudinal axis of said body, said terminal end being configured to contactingly mate with the corresponding surface of the arm of the A-frame; and (d) said terminal end including first and second means extending in opposed directions in orthogonal axes within a plane lateral of the longitudinal axis to a point rotated 90° from said securing means for suspending said terminal end from the control arm and for inhibiting tilting movement of said body about said securing means; whereby, said tool is supported upon the control arm and maintains the positional relationship of the control arm and arm of the A-frame during replacement of the bushing therebetween.

2. The tool as set forth in claim 1 wherein said first and second suspending and inhibiting means comprise first and second arms, respectively.

3. The tool as set forth in claim 2 wherein said body and said first and second arms define a section of a hollow cylinder.

* * * * *